US007082624B2

(12) United States Patent
Yen

(10) Patent No.: US 7,082,624 B2
(45) Date of Patent: Aug. 1, 2006

(54) WATER-SEPARATING APPARATUS FOR TOILET TANK

(75) Inventor: Chih-Chen Yen, Taipei (TW)

(73) Assignee: Flushtech Corporation, Taoyuan (TW)

( * ) Notice: Subject to any disclaimer, the term of this patent is extended or adjusted under 35 U.S.C. 154(b) by 0 days.

(21) Appl. No.: 11/017,817

(22) Filed: Dec. 22, 2004

(65) Prior Publication Data

US 2006/0130223 A1 Jun. 22, 2006

(51) Int. Cl.
*E03D 1/36* (2006.01)

(52) U.S. Cl. ..... 4/366; 4/367

(58) Field of Classification Search ..... 4/367, 4/366, 313, 406, 302, 332; 137/389, 872, 137/391

See application file for complete search history.

(56) References Cited

U.S. PATENT DOCUMENTS 4,793,588 A * 12/1988 Laverty, Jr. ..... 4/302
5,125,621 A * 6/1992 Parsons et al. ..... 4/406

* cited by examiner

*Primary Examiner*—Khoa D. Huynh
(74) *Attorney, Agent, or Firm*—Troxell Law Office, PLLC

(57) ABSTRACT

A water-separating apparatus for toilet tank bridges a toilet tank and a water supply includes a concentric tube, a distributing tube and a solenoid valve. The concentric tube has a large tube containing a small tube, and an inlet connecting to the water supply and an outlet connecting to the distributing tube. The solenoid valve is connected to an inlet of the small tube of the concentric tube. The distributing tube has a large tube containing a small tube, and an inlet connecting to the concentric tube and an outlet connecting to a tube of the toilet tank. The concentric tube can divide the water supply to a plurality of water flows to meet multiple water supply requirements of the toilet tank and simplify the piping configuration outside the toilet tank.

11 Claims, 3 Drawing Sheets

WATER-SEPARATING APPARATUS FOR TOILET TANK

BACKGROUND OF THE INVENTION

1. Field of the Invention

The invention relates to a water-separating apparatus for toilet tank to divide a single water supply to a plurality of water flows for a toilet tank to meet multiple water supply requirements and simplify piping configuration.

2. Description of the Prior Art

With increasing awareness of sanitary concept and to avoid inflicting diseases, many public lavatories and some household sanitary facilities have adopted photoelectric sensor control that functions without human contact. Sensor flushing toilet is one of such examples. The sensor flushing toilet can detect use condition and emit a signal to a flush mechanism to flush the toilet automatically. The flush mechanism generally includes a motor to hoist a valve to control flushing. The flush mechanism usually is installed in the toilet tank. It is prone to malfunction after having exposed to the moisture for a period of time. To remedy this problem, Applicant invented a new toilet that uses hydraulic power to control the flush valve without an electric motor. It is an automatic flushing apparatus capable of providing steady operation.

In the improved technique proposed by the applicant set forth above, a three-way connector is used to divide the water to two water supply flows connecting to the tank. However, the conventional tank has only one water inlet. To adopt the foregoing technique, an extra water inlet has to be formed on the tank. Implementation is troublesome and the tank might be damaged. To facilitate installation, a dedicated tank has to be fabricated. Moreover, using the three-way connector to bridge water supply and the tank results in two pipes exposed outside the tank. It is clutter and looks messy.

SUMMARY OF THE INVENTION

Therefore it is an object of the present invention is to solve the problems occurred to the hydraulic flushing toilet that has a cluttered piping configuration between the tank and water supply. Another object of the invention is to provide two water supply flows to the existing toilet tanks without forming an additional inlet.

To achieve the foregoing objects, the present invention provides a water-separating apparatus for toilet tank that includes a concentric tube, a distributing tube and a solenoid valve that are integrated in one set. The concentric tube has a large tube encircle a small tube. The large tube has an inlet connecting to the water supply to channel one water supply flow through the solenoid valve into an inlet of the small tube, and then flows out through an outlet of the small tube connecting to the distributing tube. Another water supply flow moves directly through the outlet of the large tube to the distributing tube. The distributing tube also has a large tube encircle a small tube, and has more than one outlet. The outlets are located in the tank.

By means of the construction set forth above, the concentric tube outside the tank divides one water supply to two water supply flows without creating a cluttered piping configuration. Moreover, pluralities of water outlets of the distributing tube are located inside the tank, and the large tube and the small tube of the distributing tube are integrated into one inlet to connect to the outlet of the concentric tube.

Therefore the conventional toilet tank with only one water inlet can also adopt the invention to take the benefits of hydraulic control flushing.

The foregoing, as well as additional objects, features and advantages of the invention will be more readily apparent from the following detailed description, which proceeds with reference to the accompanying drawings.

DESCRIPTION OF THE PREFERRED EMBODIMENT

Figure 1:
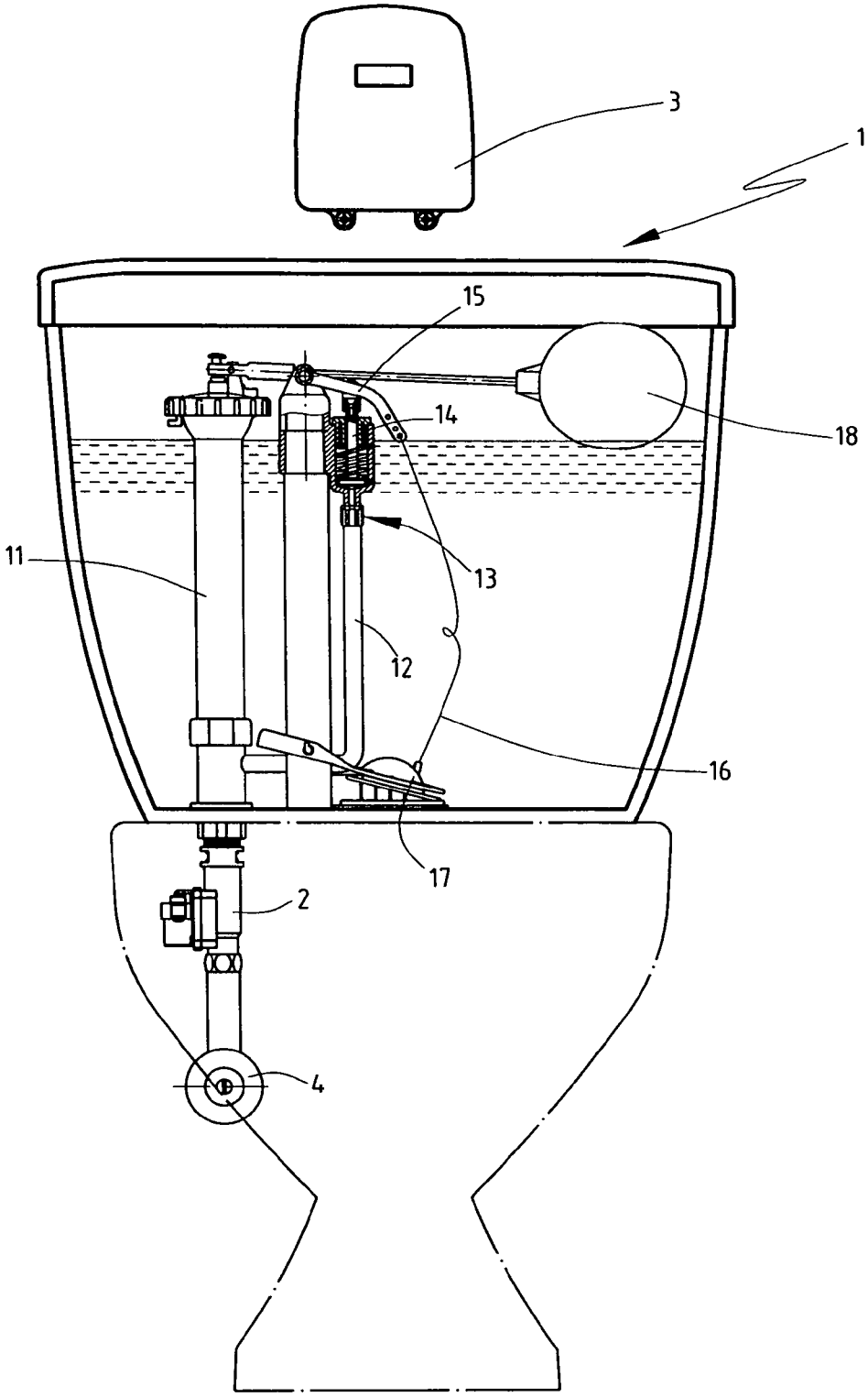
FIG. 1 is a schematic view of the invention used on a tank.

Refer to FIG. 1 for a water-separating apparatus 2 of the invention coupled with a toilet tank 1. The tank 1 has a main tube 11 to receive and replenish water into the tank until reaching a desired level. There is a secondary tube 12 connecting to a flush assembly 13. Water enters the secondary tube 12 generates an upward force to push a cylinder 14 in the flush assembly 13 to lift a lever 15. The lever 15 has a distal end fastened to a rope 16 to hoist a valve 17 so that water in the tank may flush into the toilet. The aforesaid operation is controlled by a sensor 3. The sensor 3 detects use condition of the toilet and emits a signal to the water-separating apparatus 2. Meanwhile the solenoid valve of the water-separating apparatus 2 is activated to channels the water of a water supply 4 into the secondary pipe 12. Water inlet of the main tube 11 is activated by a ball 18 when the water level in the tank drops.

Figure 2:
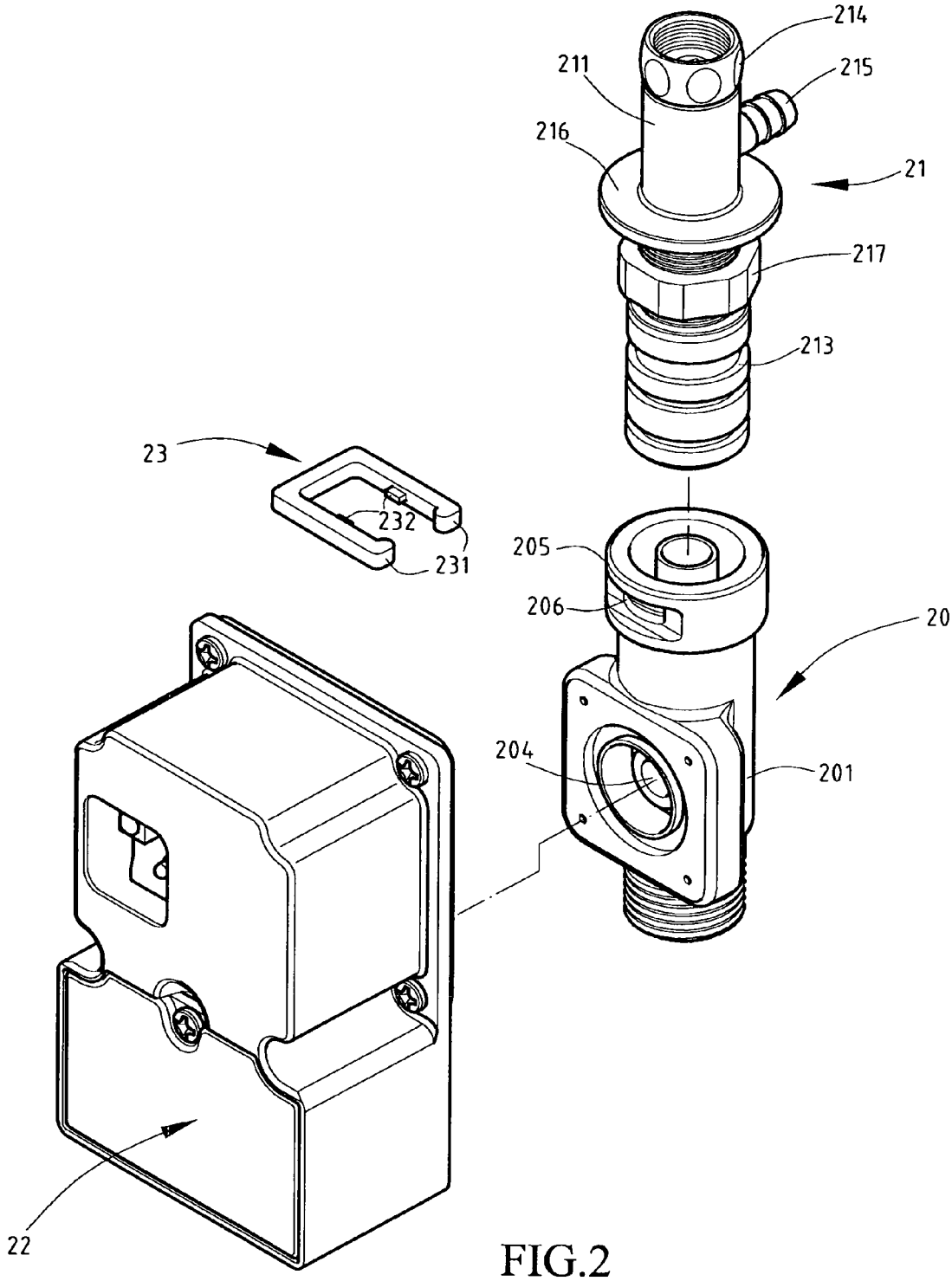
FIG. 2 is an exploded view of an embodiment of the invention.
Figure 3:
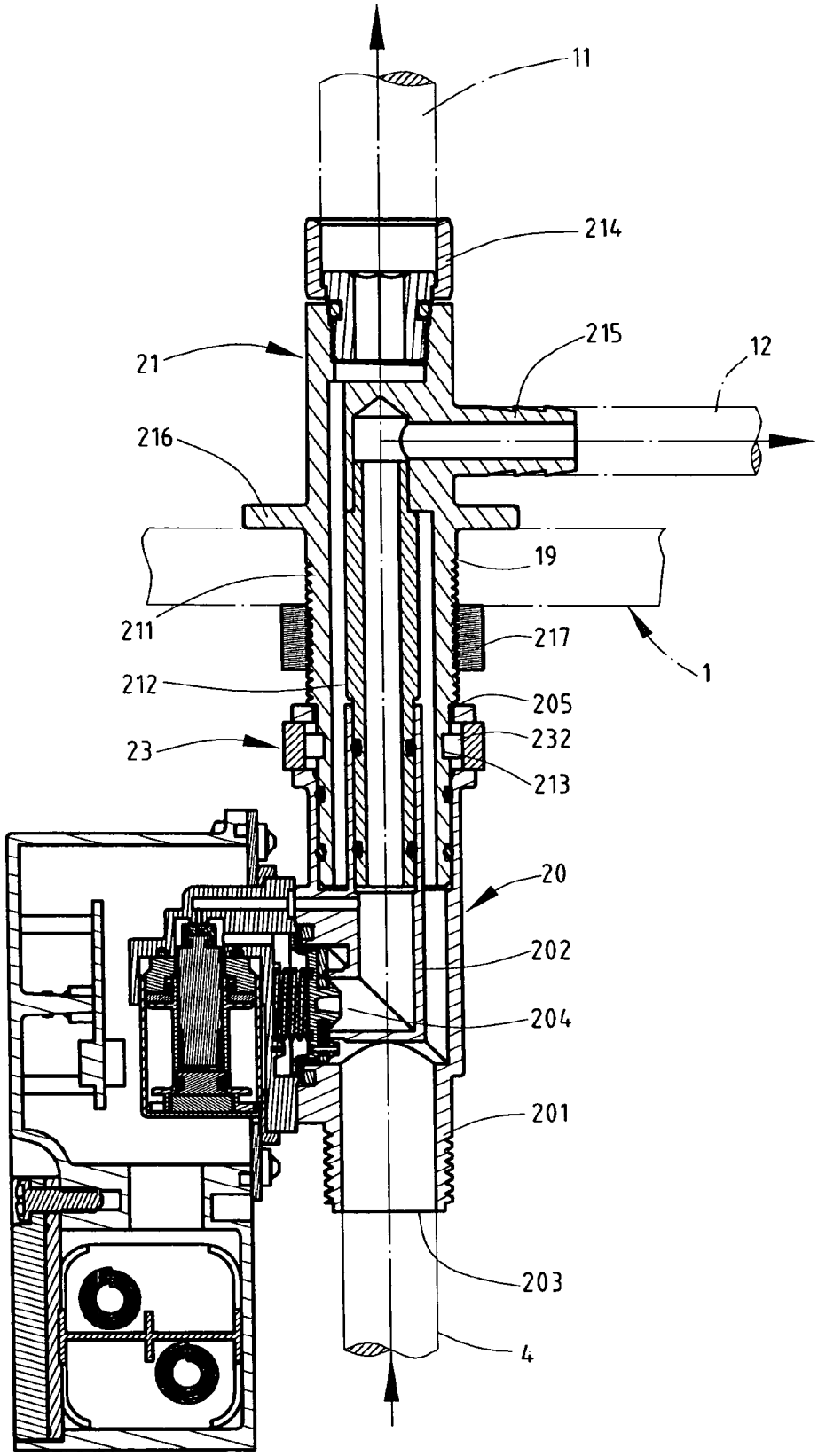
FIG. 3 is a sectional view of the embodiment shown in FIG. 2 in a use condition.

Referring to FIGS. 2 and 3, the water-separating apparatus 2 according to the invention includes a concentric tube 20, a distributing tube 21 and a solenoid valve 22 that are integrated in one set. The concentric tube 20 is an integrated tubular member having a large tube 201 containing a small tube 202 inside. The large tube 201 forms the outer diameter of the concentric tube 20 and has an inlet 203 on one end. The small tube 202 is located in the large tube 201 and has an inlet 204 formed on a transverse location of the concentric tube 20 coupling with the solenoid valve 22. The large tube 201 and the small tube 202 have a coaxial outlet 205 coupling with the distributing tube 21. The distributing tube 21 is constructed like the concentric tube 20 and has a large tube 211 and a small tube 212. The large tube 211 of the distributing tube 21 is coupled with the large tube 201 of the concentric tube 20, while the small tube 212 is coupled with the small tube 202 of the concentric tube 20. The outlet 205 of the concentric tube 20 has a groove 206 clipped by two legs 231 of a C-clip 23 as shown in FIG. 2. The C-clip 23 has two lugs 232 on two sides to latch on an indented ring 213 formed on an outer wall of the large tube 211 of the distributing tube 21. The C-clip 23 has elasticity to couple the distributing tube 21 with the concentric tube 20 together. The large tube 211 of the distributing tube 21 in this embodiment leads to the main tube 11 of the tank 1. The small tube 212 of the distributing tube 21 leads to the secondary tube 12 of the tank 1. Thus the distributing tube 21 has two outlets, one is coupled with the main tube 11 of the tank 1 through a nut 214, and another one has a saw type conical connector 215 to couple with the secondary tube 12 of the tank 1. The distributing tube 21 has a flange 216 close to the bottom end coupled on a water inlet 19 at the-bottom of the tank 1 before coupling with another nut 217 to jointly fasten to the bottom of the tank 1 to install the distributing tube 21 in the tank. Hence the concentric tube 20 is installed on the bottom of the distributing tube 21 outside the tank 1 after the distributing tube 21 has been installed inside the tank 1.

Referring to FIGS. 1 and 3, water flows from a water supply 4 through the inlet 203 of the concentric tube 20 into the large tube 201 of the concentric tube 20. A portion of the water enters the large tube 211 of the distributing tube 21 from the large tube 201 of the concentric tube 20 to the main tube 11 of the tank 1, while the rest of water flows leftwards into the solenoid valve 22. According to open and close control of the solenoid valve 22, the water may flow rightwards to the small tube 202 of the concentric tube 20 into the secondary tube 12 of the tank 1 through the small tube 212 of the distributing tube 21. Hence when the sensor 3 detects a use condition and emits a signal to the water-separating apparatus 2, the solenoid valve 22 is activated to channel water from the water supply 4 to the secondary tube 12 of the tank 1, and pushes the cylinder 14 to lift the lever 15 through the upward hydraulic force so that the rope 16 is hoisted to open the valve 17 to flush the water into the toilet. Meanwhile, the water level in the tank drops, the ball 18 is lowered to activate water inlet of the main tube 11 to replenish the water into the tank.

The structure of the invention aims to meet multiple flow water supply requirements of the main tube 11 and the secondary inlet tube 12 in the tank 1 without complicating the piping configuration between the tank and water supply. The concentric tube 20 of the invention can divide one water supply to two output water flows. The water outlets of the distributing tube 21 are not limited to two as the embodiment discussed above, and may have other selections. The locations and configuration relationship of the outlets of the distributing tube 21 discussed in the embodiment also are for illustrative purpose only, and not the limitation of the invention.

Furthermore, second preferred embodiment of the invention as shown in FIG. 1, the bottom end of the main tube 11 has a distributing tube. Therefore, the second preferred embodiment of the invention can comprise without the distributing tube 21 as the preferred embodiment of the invention afore said.

I claim:

1. A water-separating apparatus for use with a water supply and a toilet tank of a toilet comprising:

a) a concentric tube having:

i) a concentric large tube having a concentric large tube inlet connected to a water supply and a concentric large tube outlet; and ii) a concentric small tube located in the concentric large tube and having a concentric small tube inlet and a concentric small tube outlet; and b) a solenoid valve connected to an outer wall of the concentric tube and having a valve inlet communicating with an interior of the concentric large tube and a valve outlet connected to the concentric small tube inlet.

2. The water-separating apparatus according to claim 1, wherein the concentric small tube inlet is encased in the concentric large tube inlet.

3. The water-separating apparatus according to claim 1, wherein the concentric small tube inlet is perpendicular to the concentric large tube inlet.

4. The water-separating apparatus according to claim 1, wherein the concentric tube and the solenoid valve are located on a exterior of the toilet tank.

5. The water-separating apparatus according to claim 1, further comprising a distributing tube connected to the concentric tube and having:

a) a distributing large tube having a distributing large tube inlet connected to the concentric large tube outlet and a distributing large tube outlet connected to a main tube of the toilet tank; and b) a distributing small tube located in the distributing large tube and having a distributing small tube inlet connected to the concentric small tube outlet and a distributing small tube outlet connected to a secondary tube of the toilet tank.

6. The water-separating apparatus according to claim 5, wherein the concentric small tube inlet is encased in the concentric large tube inlet.

7. The water-separating apparatus according to claim 5, wherein the concentric small tube inlet is perpendicular to the concentric large tube inlet.

8. The water-separating apparatus according to claim 5, wherein the concentric tube and the solenoid valve are located on a exterior of the toilet tank.

9. The water-separating apparatus according to claim 5, wherein the distributing small tube outlet is perpendicular to the distributing large tube outlet.

10. The water-separating apparatus according to claim 5, further comprising a C-clip connecting the distributing tube to the concentric tube, the C-clip having two legs engaging a groove in the concentric tube, each of the two legs has a lug engaging a indent ring in the distributing tube.

11. The water-separating apparatus according to claim 5, wherein the distributing large tube has one outlet and the distributing small tube has one outlet.

* * * * *